US006326063B1

(12) United States Patent
Harada et al.

(10) Patent No.: US 6,326,063 B1
(45) Date of Patent: Dec. 4, 2001

(54) METHOD OF PRODUCTION OF SELF-FUSING ALLOY SPRAY COATING MEMBER

(75) Inventors: Yoshio Harada, Akashi; Hidetoshi Shin, Katsuyamamachi, both of (JP)

(73) Assignee: Tocalo Co., Ltd., Hyogo (JP)

( * ) Notice: Subject to any disclaimer, the term of this patent is extended or adjusted under 35 U.S.C. 154(b) by 0 days.

(21) Appl. No.: 09/381,956

(22) PCT Filed: Jan. 11, 1999

(86) PCT No.: PCT/JP99/00050

§ 371 Date: Sep. 28, 1999

§ 102(e) Date: Sep. 28, 1999

(87) PCT Pub. No.: WO99/39020

PCT Pub. Date: Aug. 5, 1999

(30) Foreign Application Priority Data

Jan. 29, 1998 (JP) ..... 10-017047

(51) Int. Cl.[7] ..... B05D 1/36; B05D 1/02; B05D 1/08; B05D 3/06; B05D 3/02

(52) U.S. Cl. ..... 427/532; 427/454; 427/455; 427/350; 427/376.5; 427/376.8; 427/405; 427/383.7; 427/419.2; 427/419.7; 427/422; 427/427

(58) Field of Search ..... 427/454, 455, 427/456, 350, 376.5, 376.8, 383.7, 405, 419.2, 419.7, 422, 427, 532

(56) References Cited

U.S. PATENT DOCUMENTS 3,977,660 * 8/1976 Nakahira ..... 266/265
4,161,555 * 7/1979 Appleman ..... 427/333
4,450,333 * 5/1984 Andrejco et al. ..... 219/10.49 R

FOREIGN PATENT DOCUMENTS

185430 * 6/1986 (EP) .
48-24946 3/1973 (JP) .
52-46338 4/1977 (JP) .
52-99951 8/1977 (JP) .
53-34634 3/1978 (JP) .
56141876 11/1981 (JP) .
56161863 12/1981 (JP) .
62-27561 6/1987 (JP) .
6-34041 2/1994 (JP) .
7-188892 * 7/1995 (JP) .

(List continued on next page.)

OTHER PUBLICATIONS

Abstract of SU 1713975, by Kochergin et al. (Abstract), Feb. 1992.*
English language abstract of JP 10–121126, May 1998.
English language abstract of JP 7–188892, Jul. 1995.
English language abstract of JP 6–34041, Feb. 1994.
English language abstract of JP 7–226285, Aug. 1995.
English language abstract of JP 9–25582, Jan. 1997.
English language abstract of JP 8–158030, Jun. 1996.

(List continued on next page.)

*Primary Examiner*—Shrive P. Beck
*Assistant Examiner*—Michael Barr
(74) *Attorney, Agent, or Firm*—Greenblum & Bernstein, P.L.C.

(57) ABSTRACT

A member covered with a self-fluxing alloy sprayed coating is produced by previously forming a porous ceramic sprayed coating on a surface of a self-fluxing alloy sprayed coating prior to a refusing treatment of the coating formed on a substrate, heating the sprayed coating in an inert gas atmosphere controlled to 1~300 hPa or by a high frequency induction heating system and thereafter removing the ceramic sprayed coating to expose the self-fluxing alloy sprayed coating. This member is uniform in the thickness, less in the retention of pores or oxide impurities and has a strong coating property.

20 Claims, 1 Drawing Sheet

FOREIGN PATENT DOCUMENTS

| | | |
|---|---|---|
| 7-226285 | 8/1995 | (JP) . |
| 7-278778 | 10/1995 | (JP) . |
| 8-13119 | 1/1996 | (JP) . |
| 8-158030 | 6/1996 | (JP) . |
| 8-225917 | 9/1996 | (JP) . |
| 8-253853 | 10/1996 | (JP) . |
| 9-25582 | 1/1997 | (JP) . |
| 9-31576 | 2/1997 | (JP) . |
| 10121126 | 5/1998 | (JP) . |

OTHER PUBLICATIONS

English language abstract of JP 9–31576, Feb. 1997.
English language abstract of JP 7–278778, Oct. 1995.
English language abstract of JP 8–13119, Jan. 1996.
English language abstract of JP 52–99951, Aug. 1997.
English language abstract of JP 8–225917, Sep. 1996.
English language abstract of JP (JP–A–54–151351), Nov. 1979.
English language abstract of JP 8–253853, Oct. 1996.
English language abstract of JP 53–34634, Mar. 1978.
English language abstract of JP 48–24946, Mar. 1973.
English language abstract of JP 52–46338, Apr. 1977.
English language abstract of JP 56–141876, Nov. 1981.
English language abstract of JP 56–161863, Dec. 1981.

* cited by examiner

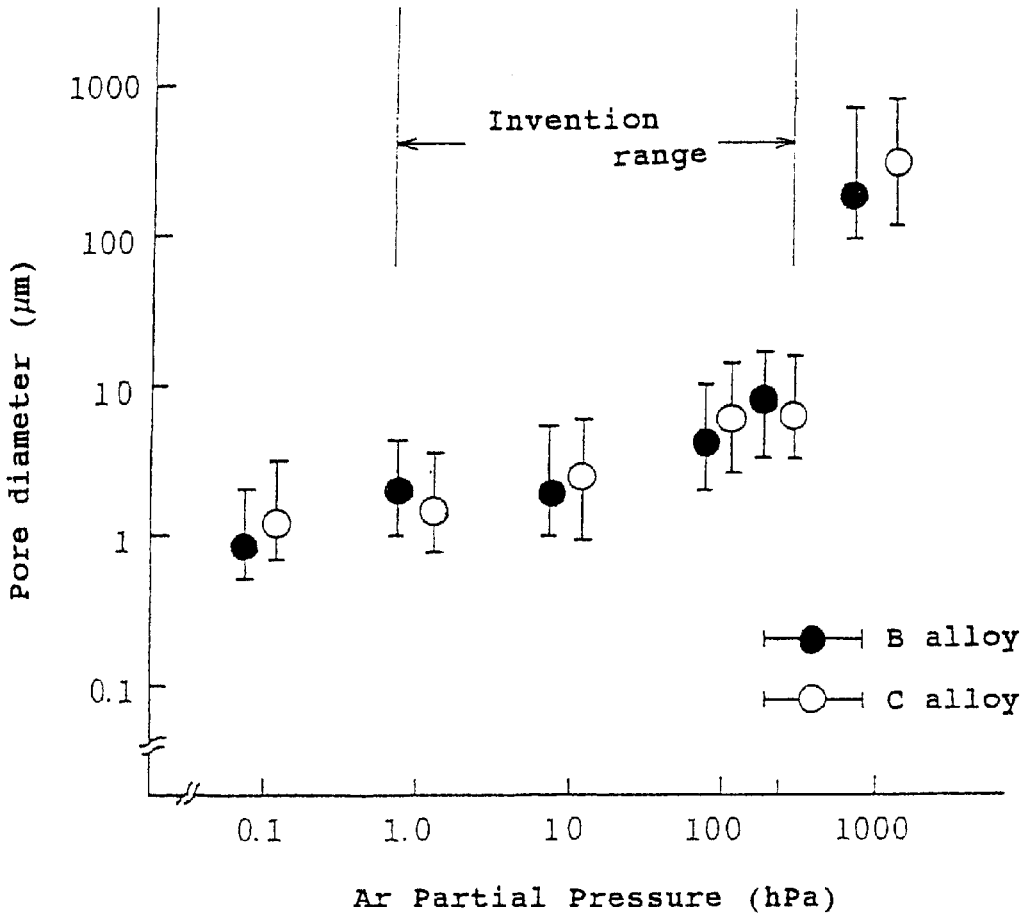
1000
100
10
1
0.1
Pore diameter (μm)
Invention range
B alloy
C alloy
0.1
1.0
10
100
1000
Ar Partial Pressure (hPa)

METHOD OF PRODUCTION OF SELF-FUSING ALLOY SPRAY COATING MEMBER

TECHNICAL FIELD

This invention relates to a method of producing a self-fluxing alloy spray-coated member and more particularly it proposes a novel refusing treatment method for forming a strong self-fluxing alloy sprayed coating on a surface of a substrate.

Moreover, the technique used in the invention is a technique wherein the self-fluxing alloy sprayed coating is refused by heating to not lower than its melting point to promote densification of such a coating and metallurgical bond to the substrate (alloy layer). And also, such a technique is applicable to the other metal and alloy.

BACKGROUND ART

The spraying method is a surface treatment method wherein fine powder of metal, ceramic, cermet or the like is fused by using plasma or a combustion energy of a combustible gas and sprayed onto a surface of a substrate to from a sprayed coating.

For example, when metal powder is sprayed in air, fine metal particles of fused state contact with air to produce an oxide film on the surface of the particle. Such a metal sprayed coating has a particle lamination structure of piling fine metal particles having a thin oxide film on their surfaces one upon the other. Therefore, the sprayed coating has problems that bonding force between mutual laminated metal particles constituting the coating is weak and the coating becomes porous to bring about the lowering of the adhesion property to the metal substrate.

In order to solve the above problems, there have hitherto been developed a method of refusing the sprayed coating by heating after the formation of the coating and an alloy suitable for this method or self-fluxing alloy (JIS H8303 Self-Fluxing Alloy Spraying).

The material for the above self-fluxing alloy spraying is a low melting point material consisting essentially of Ni or Co and added with C, Cr, Fe, Mo, Cu, W or the like and further added with Si (1.5~5.0 wt %) and B (1.0~4.5 wt %). This material lies in a point that the formation of oxide on the sprayed coating is prevented and hard chromium carbide and metal boride are formed to improve the wear resistance. Moreover, it is said that as the above material, it is favorable to use a spraying material of cermet state obtained by mixing the self-fluxing alloy and WC powder if it is intended to more enhance the wear resistance of the sprayed coating.

The conventional techniques for spraying the self-fluxing alloy are mentioned below.

(1) Utilize metallurgical bonding ability through heating-fusion phenomenon (JP-A-6-34041, JP-A-7-226285, etc.).

(2) Attempt the improvement of wear resistance of coating after refusing treatment (JP-A=9-25582, etc.).

(3) Attempt the improvement of resistance to metal fusion and corrosion resistance of self-fluxing sprayed coating after refusing treatment (JP-A-8-158030, JP-A-9-31576, JP-A-9-25582, etc.).

(4) Utilize high adhesion property, heat resistance, resistance to erosion and the like in self-fluxing alloy sprayed coating after refusing treatment to surface coating of a heat conduction tube of a boiler (JP-A-7-278778, JP-A-8-13119, etc.).

(5) Example of self-fluxing alloys other than the self-fluxing alloy defined in JIS H8303 (JP-A-52-99951, etc.).

(6) Decrease production cost by omitting refusing treatment of sprayed coating and exclude degradation of mechanical properties of substrate due to high temperature heating (JP-A-8-225917, etc.).

(7) Conventional technique for refusing treatment of self-fluxing alloy sprayed coating a. refusing treatment through a laser: JP-B-62-27561 b. refusing treatment utilizing high frequency induction heating: JP-A-7-278778, JP-A-8-253853, etc.

c. control of atmosphere in refusing treatment: JP-A-53-34634 and so on

As mentioned above, the conventional techniques for the self-fluxing alloy sprayed coating are researches and development on not only the improvement of coating properties and enlargement of their application field but also the heating and fusing treatment of the coating, but they are not yet completed to sufficient level and have the following technical problems at the present time.

(1) When the self-fluxing alloy sprayed coating is made to a fused state by heating, a portion of the coating that is easily subjected to heat locally flows to bring about the ununiformity of the coating thickness and drop-off from the surface of the substrate.

(2) When the self-fluxing alloy sprayed coating is subjected to refusing treatment, through-holes in the coating disappear and sprayed particles constituting the coating bond to each other and also metallurgically bond to the substrate. Therefore, the properties of the coating are fairly improved as compared with those before the refusing treatment. However, closed bubbles are existent in the coating, so that when the surface of the sprayed coating is polished, the bubbles are exposed on the surface and hence the smooth surface is not obtained and the application of the coating is restricted.

It is, therefore, an object of the invention to propose a method capable of preventing the fusion drop-off phenomenon of the coating when the self-fluxing alloy sprayed coating is subjected to the refusing treatment.

It is another object of the invention to propose a method capable of preventing the ununiformization of the coating thickness due to the flowing of the coating.

It is the other object of the invention to produce a member coated with a self-fluxing alloy sprayed coating having a smooth surface.

DISCLOSURE OF THE INVENTION

In the invention, the following means are adopted as a method for solving the above problems and achieving the above objects.

(1) The invention lies in a method of producing a self-fluxing alloy sprayed coating member by coating a softened or refused self-fluxing alloy sprayed coating onto a surface of a steel substrate, characterized in that a self-fluxing alloy is spray-coated onto a surface of a substrate, and a ceramic is spray-coated onto a surface of the coating, and then the resulting spray-coated member is heated in an inert gas atmosphere under a reduced pressure to refuse the self-flux alloy sprayed coating, and thereafter the ceramic sprayed coating formed on an outermost layer of the member is removed to again expose the self-fluxing alloy sprayed coating.

(2) And also, the invention lies in a method of producing a self-fluxing alloy sprayed coating member by coating a softened or refused self-fluxing alloy sprayed coating onto a surface of a steel substrate, characterized in that a self-fluxing alloy is spray-coated onto a surface of a substrate, and a ceramic is spray-coated onto a surface of the coating, and then these sprayed coatings are subjected to a high frequency induction heating in air or in an inert gas atmosphere to refuse the self-flux alloy sprayed coating, and thereafter the ceramic sprayed coating formed on an outermost layer of the member is removed to again expose the self-fluxing alloy sprayed coating.

In the invention, it is favorable to use one of ceramics selected from oxides, nitrides, carbides and borides having a specific gravity of not more than 8.0 or a mixed ceramic of two or more thereof as a ceramic to be spray-coated on the self-flux alloy sprayed coating.

In the invention, it is also favorable that the ceramic sprayed coating has a porosity: 10~80% and a thickness: 3~50 $\mu$m.

In the invention, it is further favorable to adjust temperature rising rate and heating temperature in accordance with a color of the ceramic sprayed coating in the refusing treatment of the sprayed coating.

According to the above construction, the self-fluxing alloy sprayed coating is heated to at least a flowing point to render into a refused state, so that air or gas (gas used in the spraying) included in the coating are efficiently discharged and also the bonding force between mutual sprayed particles constituting the coating and metallurgical bonding force to the substrate are improved. Therefore, the resulting sprayed coating is less in the closed cells, so that when it is subjected to a mechanical finishing work, there can be obtained a self-fluxing alloy sprayed coating having a smooth surface.

BRIEF DESCRIPTION OF THE DRAWINGS

The FIG. 1 is a graph showing a relation between Ar gas partial pressure in a heating-fusing treatment atmosphere of a self-fluxing alloy sprayed coating and pore diameter remaining in an inside of the self-fluxing alloy coating after the fusion.

BEST MODE FOR CARRYING OUT THE INVENTION

The production method according to the invention will be described in accordance with the production steps below.

(1) Formation of ceramic sprayed coating on surface of self-fluxing alloy sprayed coating A surface of a metal substrate is degreased and subjected to a blast treatment to roughen the surface, and then self-fluxing alloy powder is sprayed onto the roughened surface of the substrate by a plasma spraying method, a flame spraying method (including a high-speed flame spraying method) or the like. Thereafter, ceramic powder is sprayed onto the resulting self-fluxing alloy sprayed coating prior to refusing treatment of the sprayed coating to form a porous ceramic sprayed coating of 3~50 gm in thickness (porosity: 10~80%).

As the material for the ceramic sprayed coating temporarily coated on the self-fluxing alloy sprayed coating, an oxide, a nitride, a boride, a carbide and a mixture thereof are suitable, and particularly it is favorable to use a material having a melting point higher than that of the self-fluxing alloy, hardly reacting with components of the self-fluxing alloy and a specific gravity (not more than about 8.0) smaller than that of the self-fluxing alloy.

Because, even when the self-fluxing alloy sprayed coating is refused by heating to fluidize the sprayed coating, since the ceramic sprayed coating does not react with the self-fluxing alloy or does not fuse, if the ceramic sprayed coating is adhered to the surface of the self-fluxing alloy, it is effective to control the fluidization of the self-fluxing alloy sprayed coating to prevent the drop-off of the coating.

As an example of the ceramic satisfying the above properties, there are mentioned;

oxide: $Al_2O_3$, $Cr_2O_3$, $Nb_2O_5$, $WO_3$, $ZrO_2$, $TiO_2$, $SiO_2$ boride: $TiB_2$, $ZrB_2$, $VB_2$, $NbB_2$, $CrB_2$, NiB nitride: TiN, AlN, BN, $Si_3N4$ carbide: TiC, $B_4C$, SiC, ZrC, VC, WC, $Cr_3C_2$, NbC, TaC.

Another reason why the porous ceramic sprayed coating is formed on the surface of the self-fluxing alloy sprayed coating prior to the refusing treatment of the self-fluxing alloy sprayed coating is due to he fact that if only the self-fluxing alloy sprayed coating is directly subjected to the refusing treatment by heating in an electric furnace or by heating through a high frequency induction system without forming the ceramic sprayed coating, there is caused the following problem.

That is, the self-fluxing alloy sprayed coating is gradually softened with the rise of the temperature to start fusion and fluidized by continuing the heating. If the member to be treated has a large and complicated shape, the heating becomes ununiform. As a result, a portion of a fused state (viscosity is high) is existent, while there is locally produced a portion rendered into a fluidized state (viscosity is low). In this case, the portion of the fluidized state moves toward the lower side of the member to be treated because the viscosity is low, and hence the coating thickness becomes ununiform, or in extremely cases, the above portion fluidizes to cause the drop-off.

In the invention, therefore, ceramic particles are spray-coated on the surface of the self-fluxing alloy sprayed coating prior to the heating for refusing in order to prevent the drop-off of a part of the self-fluxing alloy sprayed coating accompanied with the aforementioned ununiform heating. When the ceramic particles are previously sprayed, the fluidized state of the self-fluxing alloy sprayed coating is suppressed and at the same time external air can be shielded to locally stop the fluidizing action.

On the other hand, in the invention, the drop-off of the coating is not caused even when the self-fluxing alloy sprayed coating is heated to such a high temperature that it is fluidized, so that the viscosity of refused coating can be more lowered and hence it is easy to remove the discharge of air or gases existing in the coating toward exterior. And also, the oxide remaining in the coating (oxide of the self-fluxing alloy produced b spraying the self-fluxing alloy in air) is separated from the alloy and easily floats up on the surface by the flux action of Si, B included as the self-fluxing alloy component because the viscosity is low and the specific gravity of the oxide is light. This means that the oxide and the like moved to the surface can be removed when the ceramic sprayed coating is removed at the post treatment or further the polishing is conducted, which is effective to provide a member having a good surface quality.

In the invention, it is desirable that the ceramic sprayed coating formed on the self-fluxing alloy sprayed coating is porous. In this case, release of air (gas) and action of separating and floating oxide are smoothly conducted and also the heating of the self-fluxing alloy sprayed coating through radiation heat is carried out in a high efficiency.

In order to obtain the above action, the ceramic sprayed coating is preferably a porous coating having a thin thickness of about 3~50 $\mu$m and a porosity of 10~80%, preferably about 20~80%. It is technically difficult to obtain the coating thickness of less than 3 $\mu$m, while when it exceeds 50 $\mu$m, the effect of the invention is not developed and economical merit is not obtained. On the other hand, when the porosity is less than 10%, the action of pores is less, while when it exceeds 80%, the flowing or drop-off of the self-fluxing alloy sprayed coating rendered into the fluidized state can not be prevented.

(2) Refusing Treatment

The member obtained by forming the ceramic sprayed coating on the surface of the self-fluxing alloy sprayed coating is then subjected to a refusing treatment for the self-fluxing alloy sprayed coating by heating. As the heating method, a system utilizing radiation heat in an inert gas atmosphere under a reduced pressure of 1~300 hPa is effective. The reason why the pressure of the atmosphere is restricted to the above range is due to the fact that when the pressure is less than 1 hPa, a long time is taken and the heating effect through gas convection can not be expected, while when it exceeds 300 hPa, the effect of releasing air gas component from the fused coating is degraded.

Moreover, the indirect heating system utilizing the radiation heat in the inert gas atmosphere does not create the oxide on the surface of the self-fluxing alloy sprayed coating of the fluidized state, so that the release of air and gases included in the coating toward exterior is easy and there can be formed a dense coating having less interior and surface defects and an excellent adhesion force.

In the heating for the refusing treatment, the ceramic sprayed coating formed on the surface of the self-fluxing alloy sprayed coating may be formed by utilizing a material developing various colors through heating in addition to a basic color inherent to the spraying material.

Thus, the heating temperature, heating time, heating rate and the like for the refusing treatment can be controlled by selecting and using the ceramic to be sprayed. For example, when white $Al_2O_3$ is sprayed, even if the self-fluxing alloy coating is somewhat over-heated, there is not caused the flowing and drop-off of the sprayed coating. On the other hand, when the member to be treated is big and is required to have a considerable heating energy, if a black coating such as $Cr_2O_3$, $TiO_2$, $Al_2O_3$-$TiO_2$ or the like is coated, the heating time can be shortened.

As the heating means for the refusing treatment, high frequency induction heating is also effective. In this heating system, there can be used methods widely adopted in industrial fields. For example, this method is carried out by arranging a copper coil capable of flowing a cooling water around the member to be heated and supplying a high frequency current to the coil. Moreover, current, voltage, frequency, heating time and the like required for the heating are properly selected in accordance with the size of the member to be heated.

(3) Post treatment (removal) of ceramic sprayed coating after heating-fusing

After the refusing treatment as mentioned above, the ceramic coating formed on the surface of the self-fluxing alloy sprayed coating is removed by various methods. Therefore, the ceramic sprayed coating is not necessarily required to have a good adhesion property, so that the spraying method is not particularly restricted. For example, if the coating can be formed by spraying alumina powder or the like with a high pressure air, it is possible to attain the method according to the invention by the above method.

That is, after the self-fluxing alloy sprayed coating is refused by heating, it is cooled and the ceramic sprayed coating adhered to the surface of the alloy coating is removed by spraying powder such as mineral slug, silica sand, $Al_2O_3$ or the like. Thereafter, it is subjected to cutting, polishing and further mirror finishing until the surface of the self-fluxing alloy sprayed coating is completely exposed by mechanical working, if necessary. The thus obtained self-fluxing alloy sprayed coating according to the invention is less in the pores retained in its inside and small in the pore size and the oxide film produced in the spraying gathers on the surface, so that a very smooth finished surface is obtained.

Moreover, as the self-fluxing alloy adapted to the method of the invention, there can be mentioned not only Ni-based, Co-based alloys defined in JIS H8303 Self-Fluxing Alloy Spraying and alloy obtained by dispersing WC particles into Co-based alloy but also Fe-based alloy (for example, 0.05C-4Si-35Cr-3.4B-remainder of Fe (wt%), melting point: 1115° C.).

EXAMPLES

Example 1

In this example, a self-fluxing alloy sprayed coating is subjected to a refusing treatment under heating by various methods and thereafter a section of the sprayed coating is observed by means of an optical microscope to measure remaining bubble and a joint state to a member to be treated.

(1) Self-fluxing Alloy Spraying Material to be Tested

An-alloy A shown in Table 1 (Ni-based self-fluxing alloy) us used as a self-fluxing alloy spraying material. Moreover, Table 1 also shows Ni-based alloy as an alloy B, Co-based self-fluxing alloy as an alloy C, Ni-based self-fluxing alloy containing WC particles as an alloy D, and Fe-based self-fluxing alloy as an alloy E.

(2) Member to be Treated

A steel pipe having an outer diameter of 38 mm, a gauge of 3.2 mm and a length of 100 mm is used as a member to be treated.

(3) Spraying Method

A self-fluxing alloy having an apparent thickness of 0.8 mm is formed on an outer surface of the member to be treated by a flame spraying method.

(4) Heating-fusing Method of Self-fluxing Alloy Sprayed Coating

① heating in an atmosphere-controlled electric furnace (heating under $N_2$ partial pressure of 10 hPa)

② high frequency induction heating (in air)

③ If heating by oxygen-acetylene combustion flame

While the self-fluxing alloy sprayed coating is heated by the above three methods, the heating is stopped at a time that a wetting and shining phenomenon of the coating arrived at its melting point is caused by visual observation, and then the coating is cooled to room temperature and cut for the measurement through microscope.

(5) Measured Results

The measured results are shown in Table 2. As seen from this table, in the high frequency induction heating (No. 2), the pore distribution created in the coating is relatively uniform and the metallurgical bond to the member to be treated (diffusion) is uniform, but the pore diameter tends to be somewhat large. In the heating by flame (No. 3), it has been confirmed that the pore distribution and diffusion to the member to be treated are ununiform and the pore diameter is large.

On the contrary, in the coating according to the invention (No. 1) heated under a reduced pressure of 10 hPa in $N_2$ gas after air is removed from the heating atmosphere, when the coating is fused, the generation of gas and release thereof are easy because of negative pressure, so that it has been found that the pores left in the coating are less and the pore diameter is smallest and the diffusion bond state to the member to be treated is even.

TABLE 1

| Symbol | Chemical composition (wt %) Ni | Cr | B | Si | C | Fe | Mo | Co | Others | Solid phase-liquid phase temperature (° C.) |
|---|---|---|---|---|---|---|---|---|---|---|
| A | Balance | 14.0 | 2.5 | 3.6 | 0.6 | 4.0 | — | — | — | 970–1070 |
| B | Balance | 17.0 | 3.5 | 4.3 | 0.9 | 4.0 | — | — | — | 940–1040 |
| C | 26.0 | 21.0 | 3.0 | 3.5 | 0.1 | 1.5 | 7.0 | Balance | — | 1090–1160 |
| D | Balance | 11.0 | 2.5 | 2.8 | 0.7 | 2.5 | — | — | WC:35.0 | 950–1035 |
| E | — | 14.0 | 3.5 | 1.0 | 1.0 | Balance | — | — | W:20.0 | 1120–1155 |

TABLE 2

| No. | Heating method | Pore distribution | Pore diameter (μm) | Metallurgical bond to member to be treated | Remarks |
|---|---|---|---|---|---|
| 1 | Heating in inert gas under a reduced pressure | Evenness | 1–5 | Uniform | Acceptable example |
| 2 | High frequency induction heating | Relatively evenness | 8–15 | Uniform | Comparative example |
| 3 | Heating by combustion flame | Unevenness | 10–50 | Ununiform | Comparative example |

(Note)
1 reduced pressure condition 10 hPa $N_2$
2 frequency 2 $KH_z$ power 70 KW
3 Combustion flame is oxygen-acetylene flame

Example 2

In this example, atmosphere for heating and refusing the self-fluxing alloy sprayed coating and size of pores left in the inside of the resulting sprayed coating are measured.

(1) Self-fluxing Alloy Material to be Tested

There are used alloys B and C shown in Table 1.

(2) Member to be Treated

There is used the same one as in Example 1.

(3) Spraying Method

A coating having a thickness of 0.7 mm is formed on the surface of the member to be treated by using the same spraying method as in Example 1.

(4) Heating-fusing Method and Atmosphere Conditions for Self-fluxing Alloy Sprayed Coating As the heating-fusing method of the self-fluxing alloy sprayed coating is used an electric furnace capable of controlling atmosphere, wherein air in the electric furnace is first removed by a vacuum pump (1×10−3 hPa) and then Ar gas is introduced to adjust a partial pressure to 0.1, 1, 10, 100 or 1000 hPa and thereafter temperature is raised by heating. The heating temperature is 1050° C. at maximum in the alloy B and 1170° C. in the alloy C.

(5) Measured Results

The self-fluxing alloy sprayed coating after the fusing treatment by heating is cut at section to measure distribution and size (outer diameter) of pores retained in the inside of the coating by means of an optical microscope. FIG. 1 shows a relation between outer diameter of pore and Ar partial pressure as a heating atmosphere.

As seen from these results, the pore diameter retained in the coating is smaller in the alloy B than that in the alloy C, and also the pore diameter becomes small when the Ar partial pressure is within a range of 0.1~300 hPa.

That is, in the alloy C, the melting point is high because Co is a main component, and the viscosity is high even at the fused state, so that the release of gas components is slow. On the contrary, in the Ni-based alloy B, the fluidity is good and the release of gas component is fast and the number of pores is small and only small pores are retained.

On the other hand, as the Ar partial pressure becomes high, the difference between gas partial pressure in the inside of the coating and partial pressure in exterior becomes small, so that the release of gas component is delayed.

Under the condition that Ar partial pressure is 0.1 hPa in this example, there is no heating action through convection of atmosphere gas, so that a long time is taken in the heating of the self-fluxing alloy sprayed coating (for example, 6 hours at 0.1 hPa and 3 hours at 10 hPa), which comes into problem from a viewpoint of the productivity. For this end, it has been confirmed that the optimum Ar partial pressure in the invention is within a range of 1~300 hPa.

Example 3

In this example, the influence of heating temperature is examined when the self-fluxing alloy sprayed coating is fused by heating under the optimum Ar partial pressure obtained in Example 2.

(1) Self-fluxing Alloy Material to be Tested and Member to be Treated

Same as in Example 2.

(2) Spraying Method and Coating Thickness

Same as in Example 2.

In this example, a porous $Al_2O_3$ sprayed coating having a porosity of 18~28% is formed on the self-fluxing alloy sprayed coating at a thickness of 30 μm as a top coat.

(3) Heating-fusing Method and Atmosphere Condition of Self-fluxing Alloy Sprayed Coating After air is removed from the same electric furnace capable of controlling atmosphere as in Example 2 by means of a vacuum pump, Ar gas is introduced and the heating temperature of the self-fluxing alloy sprayed coating is varied as follows while maintaining 10 hPa.

Alloy B: 920~1100° C. or (940~1040° C.)

Alloy C: 1070~1200° C. or (1090~1160° C.)

(4) Measured Results

The measured results are shown in Table 3. As seen from these results, the alloys B and C of No. 3 and No. 4 shown as a comparative example do not fuse at a low temperature and do not indicate the properties as a self-fluxing alloy. The former alloy is fused at about 1030° C., while the latter alloy is fused at about 1150° C., whereby there is formed a dense coating including small pores. However, both coatings are fluidized when the temperature is further raised (1055° C., 1170° C.) and flow downward by their dead weight, and hence the coating thickness becomes ununiform.

On the contrary, the coating forming $Al_2O_3$ as a top coat does not flow downward even at the same temperature and maintains the initial thickness. And also, when the coating is heated near to a fluidized state, the viscosity of the coating lowers, and the release of gases from exterior and reduction action of oxide by elementary Si, B included in the self-fluxing alloy are active and oxides and the like having a light specific gravity are easily floated from the surface of the coating, so that the number of pores in the inside of the coating is less and the homogeneous coating is obtained.

Further, when the ceramic top coat is formed on the self-fluxing alloy coating while heating it to a fluidizing point, the drop-off of the self-fluxing alloy is controlled, so that it is possible to conduct a higher temperature heating as compared with the self-fluxing alloy coating having no top coat, and hence the size of the pores left in the coating is decreased and also the temperature control range is made large and the improvement of the productivity can be expected.

Each of the above alloys D and E is sprayed at a thickness of 1.0 mm by a plasma spraying method, while the coating according to the invention is further laminated with $Al_2O_3$ having a porosity of 12~30% and a thickness of 25 μm as a top coat.

(4) Heating-fusing Method of Self-fluxing Alloy Sprayed Coating

The self-fluxing alloy spayed coating is heated and fused by using a high frequency induction heating system (frequency: 2 kHz) and gradually moving a high frequency ring disposed at the outside of the member to be treated.

(5) Results

In Table 4 are shown results examined on cut section of the self-fluxing alloy coating after the high frequency induction heating by means of an optical microscope. As shown in Table 4, when the coatings of the comparative examples (No. 3, 4) are compared with those formed by the heating method of combustion flame shown in Table 2, the pores are relatively dense and small. In the coatings according to the invention, however, the flowing or drop-off of the coating is not caused even when it is maintained at a temperature higher by about 10~20° C. than that of the above comparative example, and the pores remaining in the coating are more dense and very small. Further, when the surface of the self-fluxing alloy after the heating-fusing is ground and polished, a smooth finish surface having Ra of about 0.1 μm is obtained on the coating according to the invention, while in the coating of the comparative example, pit-shaped concave portions of 1~2 μm are observed due to the presence of pores exposed from the polished surface.

Moreover, when self-fluxing alloy sprayed coating provided with the top coat is heated under high frequency induction in Ar gas atmosphere, the oxide film created on surface of the self-fluxing alloy coating si thin and surface finishing can be conducted very easy, and the finished surface is smooth.

TABLE 3

| No. | Coating structure: Self-fluxing alloy | Coating structure: Top coat | Melting point of self-fluxing alloy (° C.) | Heating property of coating, fluidized drop-off temperature (° C.) | Pore diameter remaining on section of coating after heat fusion (μm) | Remarks |
|---|---|---|---|---|---|---|
| 1 | Alloy B | $Al_2O_3$ | 1030 ± 5 | 1070 ± 5 | 1–3 | Acceptable |
| 2 | Alloy C | $Al_2O_3$ | 1150 ± 5 | 1195 ± 5 | 0.8–3 | example |
| 3 | Alloy B | None | 1030 ± 5 | 1055 ± 5 | 1–5 | Comparative |
| 4 | Alloy C | None | 1150 ± 5 | 1170 ± 5 | 1–5 | example |

Example 4

In this example, the change of diameter in pores left inside the coating is examined when the porous ceramic sprayed layer is formed on the self-fluxing alloy sprayed coating as a top coat and treated by a high frequency induction heating system.

(1) Self-fluxing alloy Sprayed Coating to be Tested

There are used the same alloys D and E as in Table 1.

(2) Member to be Tested

Steel for boiler STBA24 defined in JIS G3462 (outer diameter: 38 mm, thickness: 3.2 mm, length: 500 mm) is used as a member to be tested.

(3) Spraying Method and Coating Thickness

TABLE 4

| No. | Coating structure: Self-fluxing alloy | Coating structure: Top coat | Pore diameter remaining on section of coating after heat fusion (μm) | Remarks |
|---|---|---|---|---|
| 1 | Alloy D | $Al_2O_3$ | 1~5 | Acceptable |
| 2 | Alloy E | $Al_2O_3$ | 0.9~3 | example |
| 3 | Alloy D | None | 8~15 | Comparative |
| 4 | Alloy E | None | 5~14 | example |

As mentioned above, according to the invention, the porous ceramic sprayed coating is temporarily formed prior to the refusing treatment of the self-fluxing alloy sprayed coating, so that it is possible to prevent the flowing and drop-off phenomenon of the self-fluxing alloy sprayed coating. Therefore, the higher temperature heating is possible as compared with the case of the usual self-fluxing alloy sprayed coating and hence the viscosity of the sprayed coating is lowered to promote the release of gases. Further, the floating of the oxide is easy and the surface quality of the self-fluxing alloy sprayed coating after the removal of the ceramic sprayed coating is good.

As a result, the rejection rate of the members covered with the self-fluxing alloy sprayed coating requiring precise finish can considerably be decreased. And also, according to the method of the invention, the operation for refusing treatment of the sprayed coating is easy.

INDUSTRIAL APPLICABILITY

The members covered with the self-fluxing alloy sprayed coating produced by the method according to the invention can be used various rollers, bush, sleeve, plunger, impeller, mechanical seal protection tube, crusher hammer, piston rod, mold, pelletizer dies and capstan in fields of production of iron-steel and nonferrous materials, members in galvanization plating bath, pump and valves, petroleum purification, petrochemical apparatuses, coal transporting devices, die-cast, production apparatuses for glass products and the like.

What is claimed is:

1. A method of producing a self-fluxing alloy sprayed coating member by coating a softened or fused self-fluxing alloy sprayed coating, onto a surface of a steel substrate, wherein a self-fluxing alloy is spray-coated onto a surface of a substrate, and a ceramic is spray-coated onto a surface of the coating, and then the resulting spray-coated member is radiation heated in an inert gas atmosphere under a reduced pressure of 1–300 hPa to fuse the self-fluxing alloy sprayed coating, and thereafter the ceramic sprayed coating formed on an outermost layer of the member is removed to again expose the self-fluxing alloy sprayed coating.

2. The method of claim 1, wherein the ceramic comprises at least one of oxides, nitrides, carbides and borides having a specific gravity of not more than about 8.0.

3. The method of claim 1, wherein the ceramic sprayed coating has a porosity of 10–80%.

4. The method of claim 3, wherein the ceramic sprayed coating has a thickness of 3–50 $\mu$m.

5. The method of claim 1, wherein temperature rising rate and heating temperature are adjusted in accordance with a color of the ceramic sprayed coating in the fusing treatment of the sprayed coating.

6. A method of producing a self-fluxing alloy sprayed coating member by coating a softened or fused self-fluxing alloy sprayed coating onto a surface of a steel substrate, wherein a self-fluxing alloy is spray-coated onto a surface of a substrate, and a ceramic is spray-coated onto a surface of the coating, and then the resulting spray-coated member is heated in an inert gas atmosphere under a reduced pressure of 1–300 hPa to fuse the self-fluxing alloy sprayed coating, and thereafter the ceramic sprayed coating formed on an outermost layer of the member is removed to again expose the self-fluxing alloy sprayed coating, the heating parameters for the fusing treatment of the self-fluxing alloy sprayed coating being adjusted by selecting a color of the ceramic.

7. The method of claim 6, wherein the color of the ceramic is black or white.

8. The method of claim 6, wherein the ceramic comprises at least one of oxides, nitrides, carbides and borides having a specific gravity of not more than about 8.0.

9. The method of claim 6, wherein the ceramic sprayed coating has a porosity of 10–80%.

10. The method of claim 9, wherein the ceramic sprayed coating has a thickness of 3–50 $\mu$m.

11. A method of producing a self-fluxing alloy sprayed coating member by coating a softened or fused self-fluxing alloy sprayed coating onto a surface of a steel substrate, wherein a self-fluxing alloy is spray-coated onto a surface of a substrate, and a ceramic is spray-coated onto a surface of the coating, and then these sprayed coatings are subjected to a high frequency induction heating in air to fuse the self-fluxing alloy sprayed coating, and thereafter the ceramic sprayed coating formed on an outermost layer of the member is removed to again expose the self-fluxing alloy sprayed coating, the heating parameters for the fusing treatment of the self-fluxing alloy sprayed coating being adjusted by selecting a color of the ceramic.

12. The method of claim 11, wherein the color of the ceramic is black or white.

13. The method of claim 11, wherein the ceramic comprises at least one of oxides, nitrides, carbides and borides having a specific gravity of not more than about 8.0.

14. The method of claim 11, wherein the ceramic sprayed coating has a porosity of 10–80%.

15. The method of claim 14, wherein the ceramic sprayed coating has a thickness of 3–50 $\mu$m.

16. A method of producing a self-fluxing alloy sprayed coating member by coating a softened or fused self-fluxing alloy sprayed coating onto a surface of a steel substrate, wherein a self-fluxing alloy is spray-coated onto a surface of a substrate, and a ceramic is spray-coated onto a surface of the coating, and then these sprayed coatings are subjected to a high frequency induction heating in an inert gas atmosphere to fuse the self-fluxing alloy sprayed coating, and thereafter the ceramic sprayed coating formed on an outermost layer of the member is removed to again expose the self-fluxing alloy sprayed coating, the heating parameters for the fusing treatment of the self-fluxing alloy sprayed coating being adjusted by selecting a color of the ceramic.

17. The method of claim 16, wherein the color of the ceramic is black or white.

18. The method of claim 16, wherein the ceramic comprises at least one of oxides, nitrides, carbides and borides having a specific gravity of not more than about 8.0.

19. The method of claim 16, wherein the ceramic sprayed coating has a porosity 10–80%.

20. The method of claim 19, wherein the ceramic sprayed coating has a thickness 3–50 $\mu$m.

* * * * *

UNITED STATES PATENT AND TRADEMARK OFFICE

CERTIFICATE OF CORRECTION

PATENT NO. : 6,326,063 B1
DATED : December 4, 2001
INVENTOR(S) : Y. Harada et al.

It is certified that error appears in the above-identified patent and that said Letters Patent is hereby corrected as shown below:

Column 12,
Line 56, after "porosity" insert -- of --.
Line 58, after "thickness" insert -- of --.

Signed and Sealed this

Seventeenth Day of September, 2002

*Attest:*

*Attesting Officer*

JAMES E. ROGAN
*Director of the United States Patent and Trademark Office*